US007111533B1

(12) United States Patent
Ran

(10) Patent No.: US 7,111,533 B1
(45) Date of Patent: Sep. 26, 2006

(54) MULTIPLE BIT SCREWDRIVER

(76) Inventor: Yaar Ran, 405 - 1088 Quebec Street, Vancouver, BC (CA) V6A 4H2

( * ) Notice: Subject to any disclaimer, the term of this patent is extended or adjusted under 35 U.S.C. 154(b) by 0 days.

(21) Appl. No.: 11/085,686

(22) Filed: Mar. 22, 2005

(51) Int. Cl.
*B25G 1/08* (2006.01)

(52) U.S. Cl. ..... 81/490; 84/436; 84/438; 84/439; 84/492; 7/165; 7/167

(58) Field of Classification Search ..... 81/436, 81/438, 439, 490, 492; 7/165, 167
See application file for complete search history.

(56) References Cited

U.S. PATENT DOCUMENTS 686,424 A * 11/1901 Smith ..... 81/438
939,079 A * 11/1909 Peck ..... 81/490
5,842,394 A * 12/1998 Hwang ..... 81/439

* cited by examiner

*Primary Examiner*—Lee D. Wilson
*Assistant Examiner*—Shantese L. McDonald

(57) ABSTRACT

A multiple bit screwdriver comprising a plurality of tool bits, an elongate member defining an axial passage adapted to receive said bits therein positioned tip to end so that the foremost bit operably extends from the passage and is rotatable with the elongate member, first and second retainers connected to the elongate member near each end of the passage and extending radially inward into the passage to engage frictionally the foremost and last bits to prevent said bits from falling out of either end, and a motion restricting member within the passage having an expandable engagement portion that cooperates with at least one tool bit to permit the movement of bits within the passage in one direction only. The engagement portion is expandable in response a tool bit being pushed therethrough in one direction, but resists expanding when a tool bit is being pushed in the opposite direction.

15 Claims, 3 Drawing Sheets

MULTIPLE BIT SCREWDRIVER

BACKGROUND OF THE INVENTION

1. Technical Field

The present invention relates to a multiple bit screwdriver, and more particularly, to a pocket screwdriver having multiple interchangeable tool bits received and retained removably in a tubular handle body.

2. Description of the Related Prior Art

Since a variety of screwdriver bit types are required for different purposes, various modular screwdrivers have been suggested. An example of the conventional modular screwdriver generally includes a handle and tool bits with various head types or tips. In use, a desired tool bit is selected and secured to one end of the handle, and the remaining tool bits are received in a casing. Carrying of the handle and the casing with multiple tool bits received therein for outdoor use in relatively inconvenient to the user.

An example of a multiple bit screwdriver is U.S. Pat. No. 4,827,812 granted on May 9, 1989 to Markovetz, describing a screwdriver using a hollow shaft with first and second ends. The first end has an interior cavity adapted to engage a shank of a screwdriver tip. A magnet is attached to the interior of the hollow shaft for holding the screwdriver tip inserted in the first end. The magnet divides the hollow shaft in a storage compartment and tool-receiving compartment. A torque cap is used. It consists of three segments: a first segment is sized for insertion into the torque cap-receiving hole; a second segment extends from the first segment and is sized for insertion into the storage compartment; and a third segment extends also from the first segment, oppositely to the second segment. The first and second segments are fitted with detent balls. The above pocket screwdriver presents several shortcomings. First, it has a limited capacity for storage, due to the space taken by first and second segments. Secondly, the magnet prevents the use of this screwdriver near computers or other magnet sensitive devices.

U.S. Pat. No. 5,450,775 granted on Sep. 19, 1995 to Kozak for a "Multiple function driving tool" describes a tool having first and second ends with the first end having an opening for receiving a screwdriver tip, while the second end has an opening for receiving a tube which is releasably retained, in relation to the handle, by a collet. The handle has opposed side openings extending from the second end to a point near the collet. The tube is mounted for a limited axial sliding movement relative to the handle, from a position where one of its ends is retained by the collet, to a position where it is no longer retained by the collet. Thus, one can position the tube in alignment with the side opening in the handle. The tube is also mounted for pivoting movement when it is in alignment with the side opening, to a generally transversally extending position. The tube is of a length sufficient to always project outwardly of the handle, when the tube is generally in actually aligned relation to the handle. Kozak's structure has several shortcomings. First, the pivoting of the whole tube in the handle and its limited axial sliding movement relative to the handle complicates the tool configuration. Second, due to this complicated structure the components do not easily cooperate.

U.S. Pat. No. 5,842,394, granted on Dec. 1, 1988 to Hwang for a "Multiple bit screwdriver" discloses a tubular handle body with a first end position, and opposite second end position and an axial bore formed through the first and second end positions. A plurality of tool tips are inserted into the axial bore via the first end position, and are removable from the axial bore via the second end position. Each of the tool tips has a bit portion and a connecting sleeve on one end of the bit portion. The connecting sleeve has an axial blind hole formed therein to allow extension of the bit portion of an adjacent tool bit therein. First and second spring units are respectively provided on the first and second end portions, where they extend radially inward into the axial bore. The first spring unit engages frictionally and resiliently the connecting sleeve of a first one of the tool tips, that is located in the first end portion of the handle body, so as to prevent the tool tips from falling out of the first end portion. The second spring unit engages frictionally and resiliently the connecting sleeve of the second one of the tool tips that has the bit portion extending out of the second end portion. The second spring prevents the tool bits from falling out of the second portion. An important shortcoming of this screwdriver is its reliance on special, non-standardized, bits which are not common in the field of interchangeable screwdriver bits.

SUMMARY OF THE INVENTION

There is, accordingly, a need for a multiple bit screwdriver, which overcomes the disadvantages of the prior art. It is further desirable to have a multiple bit screwdriver, which is simple to assemble, practical to use and which can accommodate standardized interchangeable screwdriver bits that are widely available in the industry.

Accordingly, in some embodiments of the present invention there is provided a multiple bit screwdriver comprising a plurality of tool bits, each bit having a tip and a shank; an elongate member having a first end and an opposite second end and defining an axial passage therethrough between the first and second ends, the passage being adapted to receive said tool bits therein positioned tip to end in a manner such that the tip of the foremost bit is able to operably extend from the first end, and wherein at least a portion of the passage near the first end is contoured for engagement with the shank of the foremost so that said bit is rotatable with the elongate member; a first retainer connected to the elongate member at the first end and extending radially inward into the passage to engage frictionally the foremost bit to prevent said bit from falling out of the first end; a second retainer connected to the elongate member at the second end and extending radially inward into the passage to engage frictionally the last bit to prevent said bit from falling out of the second end; a motion restricting member within the passage having an engagement portion that cooperates with at least one tool bit to permit the movement of bits within the passage in a first direction from the second end to the first end but not in the opposite direction. The motion restricting member may be tubular and mounted coaxially within the passage. In some embodiments, the engagement portion of the motion restricting member comprises a stricture portion expandable between a resting state in which the stricture portion has an outlet that is narrower than the cross-sectional dimension of a tool bit shank, and an expanded state in which the outlet is large enough to permit a tool bit to pass therethough. In some embodiments, the stricture portion is expandable in response a tool bit being pushed therethrough in the first direction by a user, but which resists expanding when a tool bit is being pushed in the opposite direction. In some embodiments, the stricture portion comprises a plurality of longitudinal projections extending from the tubular portion of motion restricting member and gradually tapering toward the axis of the passage in the first direction, and each of the projections is deformable radially in response to the movement of a tool bit through the stricture portion in the first direction, but is resilient axially to restrict movement of the tool bit in the opposite direction. The contoured portion of the passage may be hexagonal in cross section so as to accommodate tool bits having hexagonal shanks. In some embodiments, the first retainer comprises a tip member connected to the first end of the elongate member and having an elastomeric flange portion that extends inwardly into the passage to define a tip opening that is slightly less than the cross sectional dimensions of a tool bit shank. The second retainer comprises an elastomeric ring member connected to the elongate member adjacent the second end and being coaxially aligned with the passage, the ring member defining an inlet opening at the second end of the passage that is slightly less than the cross sectional dimensions of a tool bit shank.

In some embodiments of the present invention, there is provided a multiple bit screwdriver comprising a plurality of tool bits, each bit having a tip and a shank; a tubular member having a tip end and an opposite cap end and defining a first axial cavity extending from the tip end to the cap end; a cap member having a connecting portion and a back end portion, and defining a second axial cavity extending from the connecting portion to the back end portion, the cap member further being connected at the connecting portion to the cap end of the tubular member such that the first and second cavities align axially to define an axial passage extending between the tip end of the tubular member and the back end portion of the cap member, said passage being adapted to receive said bits therein positioned tip to end in a manner such that the tip of the foremost bit is able to operably extend from the tip end, and wherein at least a portion of the passage near the tip end is contoured for engagement with the shank of the foremost so that said bit is rotatable with the tubular member; a first retainer connected to the tip end of the tubular member and extending radially inward into the passage to engage frictionally the foremost bit to prevent said bit from falling out of the tip end; a second retainer connected to the cap member near the back end portion and extending radially inward into the passage to engage frictionally the last bit to prevent said bit from falling out of the back end portion; a motion restricting member mounted within the second cavity of the cap member and having an engagement portion that cooperates with at least one tool bit to permit the movement of bits within the passage in a first direction from the back end to the tip end, but not in the opposite direction. The motion-restricting member may be tubular and mounted coaxially with the passage. In some embodiments, the engagement portion of the motion restricting member comprises a stricture portion expandable between a resting state in which the stricture portion has an outlet that is narrower than the cross-sectional dimension of a tool bit shank, and an expanded state in which the outlet is large enough to permit a tool bit to pass therethough. The stricture portion may be expandable in response a tool bit being pushed therethrough in the first direction by a user, but resists expanding when a tool bit is being pushed in the opposite direction. In some embodiments, the stricture portion comprises a plurality of longitudinal projections extending from the tubular portion of motion restricting member and gradually tapering toward the axis of the passage in the first, and each of the projections is deformable radially in response to the movement of a tool bit through the stricture portion in the first direction, but is resilient axially to restrict movement of the tool bit in the opposite direction. The contoured portion of the passage may be hexagonal in cross section so as to accommodate tool bits having hexagonal shanks. In some embodiments, the first retainer comprises a tip member connected to the tip end of the tubular member and having a elastomeric flange portion that extends inwardly into the passage to define a tip opening that is slightly less than the cross sectional dimensions of a tool bit shank. The second retainer comprises an elastomeric ring member connected adjacent the back end portion of the cap and being coaxially aligned with the passage, the ring member defining an inlet opening at the second end of the passage that is slightly less than the cross sectional dimensions of a tool bit shank.

BRIEF DESCRIPTION OF THE DRAWINGS

Although the characteristics features of the invention will be particularly pointed out in the claims, the invention itself and the manner in which it may be made and used may be better understood in the following description taken into connection with the accompanying drawings, wherein like reference numerals refer to like parts throughout the several views, in which:

DESCRIPTION OF A PREFERRED EMBODIMENT

Figure 1:
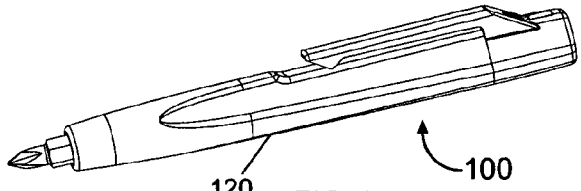
FIG. 1 is a perspective view of an embodiment of a multiple bit screwdriver in accordance with the present invention.
Figure 2:
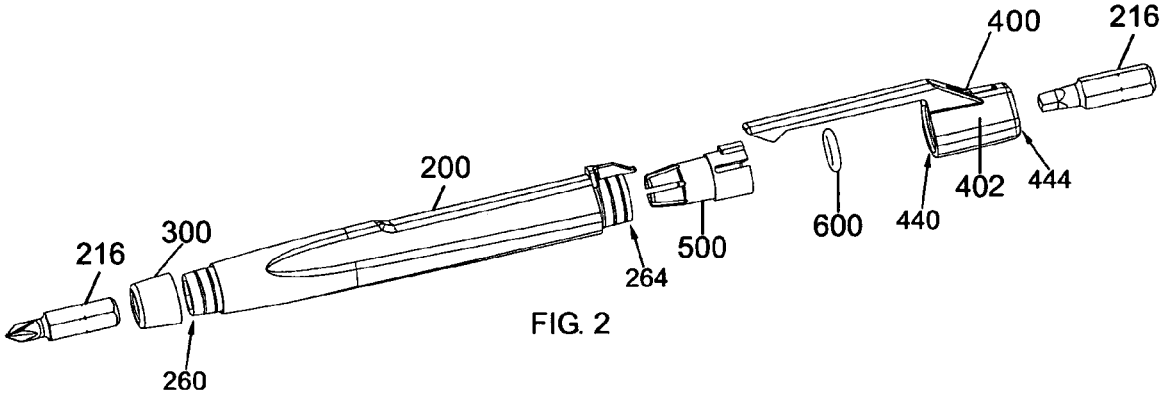
FIG. 2 is a perspective exploded view of the multiple bit screwdriver in FIG. 1.
Figure 3:
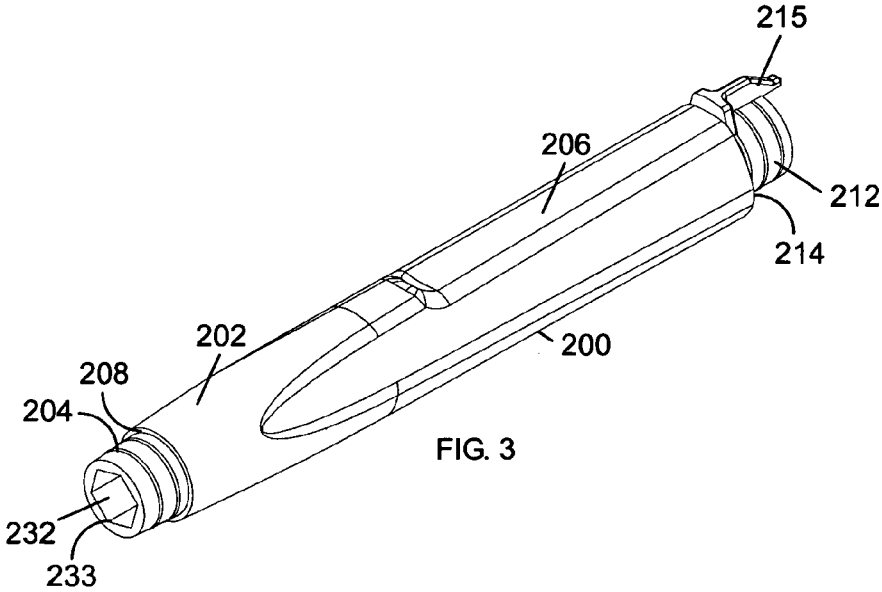
FIG. 3 is a perspective view of the tubular member of the multiple bit screwdriver in FIG. 1.
Figure 4:
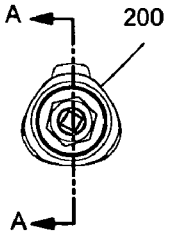
FIG. 4 is an end view of the multiple bit screwdriver from the second end.
Figure 5:
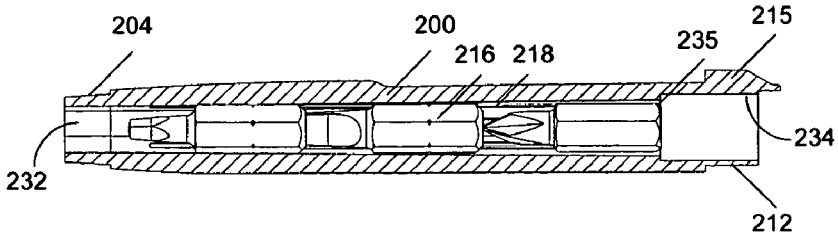
FIG. 5 is a longitudinal section view of the tubular member along plane A—A in FIG. 4 showing interchangeable screwdriver bits within the passage positioned tip to end.

Referring to FIGS. 1 to 16, a multiple bit screwdriver 100 generally comprises an elongate member 120, which according to the illustrated embodiment, includes an tubular member 200 with a tip end 260 and an opposite cap end 264, and a cap member or cap 400. A tip member or tip 300 is connected to the tip end 260 and the cap 400 is connected to the cap end 264. A motion restricting member 500, and a second retainer member such as O-ring 600, are received within cap 400. Screwdriver 100 further includes interchangeable screwdriver bits 216, each having a tool tip 222 and a shank 220 that is hexagonal in cross section.

Figure 7:
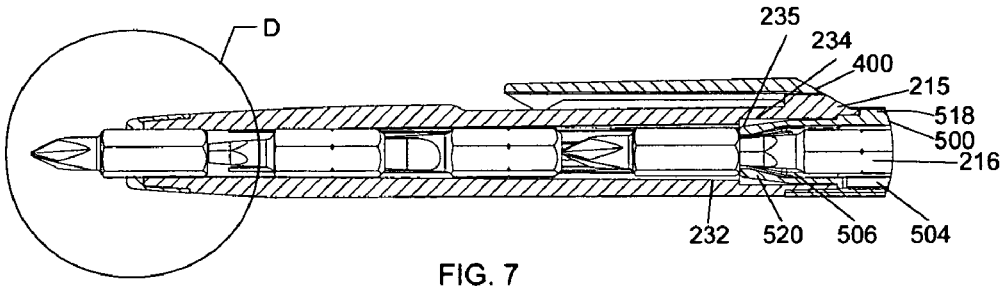
FIG. 7 is a longitudinal section view of the multiple bit screwdriver along plane C—C in FIG. 6 showing interchangeable screwdriver bits within the passage positioned tip to end with the tool tip of the foremost bit extending from the tip end of the tubular member.
Figure 6:
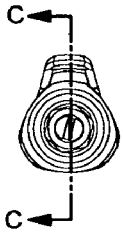
FIG. 6 is an end view of the multiple bit screwdriver from the first end.
Figure 8:
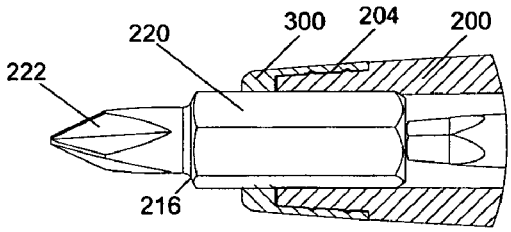
FIG. 8 is a magnified cross section of a portion D in FIG. 7 showing the tip member and a portion of the tubular member with an interchangeable screwdriver bit.
Figure 9:
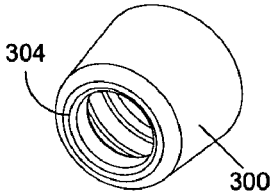
FIG. 9 is the perspective view of the tip member viewed from the front.
Figure 10:
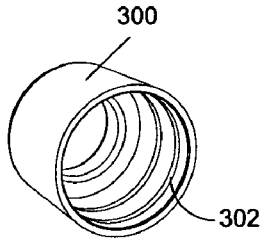
FIG. 10 is the perspective view of the tip member viewed from the back.
Figure 11:
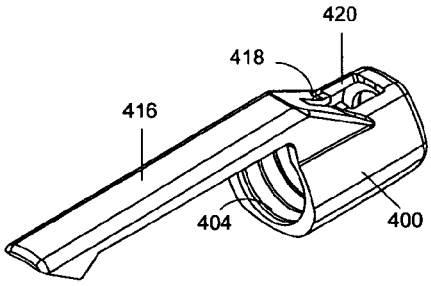
FIG. 11 is a perspective view of the cap viewed from the front.
Figure 12:
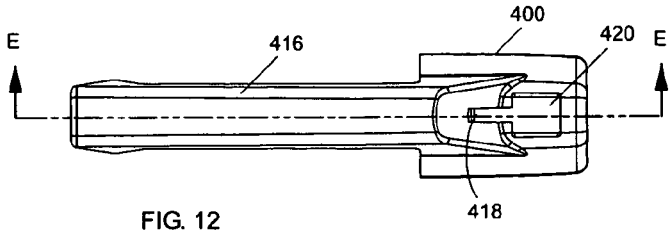
FIG. 12 is a top plan view of the cap.
Figure 13:
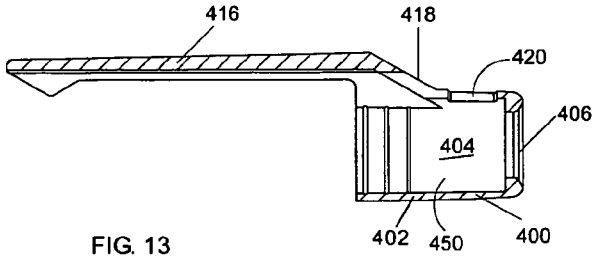
FIG. 13 is a longitudinal section view of the cap along plane E—E in FIG. 12.

Tubular member 200 defines a first axial cavity 218 extending from the tip end 260 to the cap end 264. Cap 400 includes a connecting end portion 440 for connecting to the cap end 264 of the tubular member 200, and a back end portion 444. Within cap 400 is defined a second axial cavity 450 extending from the connecting end portion 440 to the back end portion 444. When tubular member 200 and cap 400 are connected to define the elongate member, the first and second cavities align axially to define an axial passage within the elongate member, the passage having a first end that is commensurate with tip end 260 of tubular member 200 and an opposite second end that is commensurate with back end portion 444 of cap 400 for receiving and storing screwdriver bits 216 arranged in a tip to end orientation in axially spaced relation to elongate member. The overall length of the elongate member, hence the axial passage, is preferably such that in the operable configuration of the screwdriver as shown in FIG. 7, the foremost bit extends from the tip end 260 with its tool tip 222 exposed, and the shank of the last bit is entirely within cap 400.

Tubular member 200 has, in cross section, a generally trapezoidal periphery with rounded corners. Towards tip 300, tubular member 200 extends axially and changes in a truncated cone 202, followed by a first cylindrical end 204 at tip end 260. One of the external faces of tubular member 200 has, on a part of its length, a flattened surface 206. First cylindrical end 204 has a reduced cross section in comparison with the smallest cross section of truncated cone 202 to define a first shoulder 208. Tubular member 200, at the end where cap 400 is disposed, extends into a second cylindrical end 212, having a reduced cross section in comparison with the main cross section of tubular member 200 to define a second shoulder 214. Cylindrical end 212 is provided on its periphery with a longitudinally extending rib 215.

Axial cavity 218 of tubular member 200 includes a hexagonal portion 232 that is hexagonal in cross section and commensurate with the shank 220 of bits 216 to allow easy passage longitudinally of the bits therethrough. Accordingly, hexagonal portion 232 is contoured for rotating engagement with the shank 220 of bits 216 so that the bits are rotatable with the tubular member. In the illustrated embodiment, the hexagonal portion 232 extends from tip end 260 to a junction 235 located proximate to the cylindrical end 212, and a cylindrical portion 234 that extends from the junction 235 to the cap end 264. However, the hexagonal portion may be of varied length provided that at least a portion of the axial passage near the first end is hexagonal and thereby contoured for rotating engagement with at least the foremost bit. The cross sectional dimension of the first axial cavity in the cylindrical portion 234 is larger than the cross sectional dimension of the first axial cavity in the hexagonal portion 232.

Tip 300 is preferably of an elastomeric material and has truncated hollow cone form which extends as a continuation of truncated cone 202 of tubular member 200 for aesthetics. A cylindrical opening 302 passes through tip 300 except at the outer end where an inwardly extending centering flange or rim 304 is formed. The latter has a circular aperture, which dimensionally coincides with hexagonal cross section of hexagonal section 232 such that the diameter of the circular aperture is generally equal to the distance between opposing sides of the hexagonal cross section. The purpose of tip 300 is to frictionally engage the shank 220 of a screwdriver bit 216 when such screwdriver bit is within tip 300 and tip end 260, while the screwdriver bit's tip 222 projects outwardly from tip 300. Thus, an interchangeable screwdriver bit 216 that is located in tip 300 is prevented from falling out and successive interchangeable screwdriver bits disposed behind it are confined in the axial passage of screwdriver.

Cap 400 has a lateral wall 402, which generally has in cross section the same trapezoidal periphery with rounded corners as tubular member 200. An interior surface 404 of the second axial cavity of cap 400 is basically cylindrical. Cap 400 has a disk shaped opening 406, which is defined by an inwardly extending rounded rim and has a cross section larger than the hexagonal cross section of shank 220 of screwdriver bits 216. Seated within cap 400 adjacent the opening 406 is provided a retainer such as elastomeric O-ring 600 having an internal diameter that is slightly less than the hexagonal cross section of shank 220 of the interchangeable screwdriver bits 216. Accordingly, a portion of the O-ring extends radially inward into the passage to engage frictionally the shank of a bit that is within the cap. It is contemplated that a variety of analagous retainer configurations may be used, such as for example, elastomeric dimples located within cap on the interior 404 that are dimensioned to frictionally engage the shank of a bit within the cap. Alternatively, an elastomeric retainer may be integrally molded to the cap 400 in a variety of ways such that a portion thereof engages the shank of a bit within the cap.

At the top of the cap, lateral wall 402 extends first outwardly and then downwardly forming a clip 416. The latter is intended to be disposed, when multiple bit screwdriver 100 is assembled, above flattened surface 206 of tubular member 200. In the wall of the cap 400, adjacent clip 416, is provided a rectangular aperture 420 and a longitudinal channel 418 that communicates with the rectangular aperture 418. The longitudinal channel 418 is dimensioned to receive rib 215 of the tubular member 200 to align the tubular member with the cap 400 and prevent rotation between the tubular member 200 and the cap 400 in the assembled screwdriver 100.

Motion restricting member 500 is generally tubular and includes a cylindrical posterior portion 504, a cylindrical mid portion 506, an anterior portion 508. The motion restricting member 500 further includes an inlet end 510 at the posterior portion and an outlet 512 at the anterior portion. The periphery of posterior portion 504 of the motion restricting member is dimensioned for a close fit within the interior 404 of the cap 400. On the external periphery of the posterior portion 504 is tongue 518 adjacent the inlet end 510, which is dimensioned to be complimentary to the rectangular aperture 420 of the cap 400 such that the tongue 518 fits within the aperture 518 when the motion restricting member 500 is seated within the cap 400. The external cross section of the mid portion 506 and the anterior portion 508 are reduced in relation to the external cross section of the posterior portion 504 so as to form a shoulder 514. The internal cross sectional dimensions of the posterior and mid portions are equal to each other, and are preferably slightly larger than shank 220 of an interchangeable screwdriver bit 216 to enable passage of the screwdriver bit therethrough.

The anterior portion 508 of the motion restricting member acts as an engagement portion that cooperates with bits 216 to permit the movement of bits within the passage in a first direction from the back end to the tip end, but not in the opposite direction. The anterior portion is comprised of six finger-like projections 520 extending longitudinally from the mid portion 506 and tapering in the first direction towards the axis of the passage such that the projections define a shape generally that of a truncated cone. The cross sectional dimension of the outlet end 512 must be smaller than the cross sectional dimensions of the shank 222 of the screwdriver bits 216. Grooves 524 are defined between the projections and are spaced so that each groove lines up with a corner defined by the hexagonal portion 232 of the passage 218 upon assembly of the screwdriver 100.

The projections 520 are resiliently deformable radially in an outward direction relative to the motion restricting member to enable the enlargement of the outlet end 512, but are resilient to axial compression. The projections thereby provide a stricture in the motion restricting member. The motion restricting member is preferably constructed of a thermoplastic or like material which provides the resiliently deformable characteristics and ease of manufacture. However, it would be apparent to a person skilled in the art that other suitable material may be used, including various metals. As a result of the projections 520 being resiliently deformable, a screwdriver bit 216 may be inserted into the motion restricting member 500 from the inlet end 510, and by applying an axial force to the bit in the first direction, the tip 222 of the bit displaces the projections by a cam-like action to enlarge the outlet end 512 into an expanded state of the projections thus enabling the egress of the bit 216 from the motion restricting member. Once the screwdriver bit 216 has passed through the anterior portion, the projections resume their static shape in a resting state. Accordingly, the motion restricting member 500 allows a one-way passage of the screwdriver bit 216 therethrough.

In the assembled screwdriver 100, the posterior portion 504 of the motion restricting member is seated within the interior of the cap 400 such that the tongue 518 is received within rectangular aperture 420, and the inlet end 510 abuts the O-ring 600. The cooperative fit between the tongue and the aperture locks the motion restricting member to the cap by inhibiting rotation and sliding of the motion restricting member in relation to the cap. Preferably, the tongue is located along the periphery of the posterior portion at a position where, when the tongue is received into the aperture, the grooves 524 of the anterior portion 508 of the motion restricting member line up with corners 233 of the hexagonal section 232, and the projections line up with the flat surfaces within the hexagonal section. While, in the described embodiment, the tongue and aperture structures are utilized as a method of preventing movement of the motion restricting member within the cap, other methods of immovably connecting the motion restricting member to the cap may be used and would be apparent to persons skilled in the art.

In the preferred embodiment, the length of the motion restricting member 500 from inlet end 510 to outlet end 512 is approximately equal to the length of a screwdriver bit 216. However, it is possible to utilize a motion restricting member of varying length. As well, in the assembled multiple bit screwdriver 100, the distance from the O-ring 600 within the cap 400 to the junction 235 in the passage 218 is approximately equal to the length of the motion restricting member 500 such that, in the assembled screwdriver, the mid and anterior portions 506 and 508 of the motion restricting member extend into the cylindrical portion 234 of the tubular member 200, and the outlet end 512 of the motion restricting member is positioned adjacent the junction 235. However, other configurations are possible.

For retaining tip 300 and cap 400 on tubular member 200, the external surfaces of first and second cylindrical ends 204 and 212, respectively, and the surfaces of cylindrical opening 302 in tip 300, and of interior 404 in cap 400, are knurled or provided with ridges or ribs for snapping. Alternatively, tip 300, cap 400 and tubular member 200 can be permanently attached by gluing, welding or other means. Since various methods of attachment are well known to persons skilled in the art, further detailed discussion of this aspect of attachment is not deemed necessary.

Figure 14:
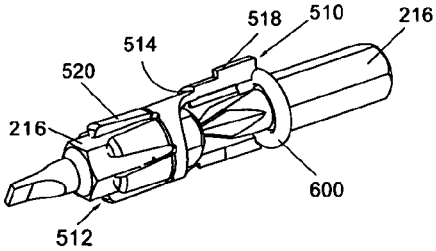
FIG. 14 is the perspective view of the motion restricting member showing one screwdriver tip as it emerges from the projections of the motion restricting member, with a portion of the motion restricting member cut away to reveal two screwdriver bits, one as it emerges from the motion restricting member and one as it enters the motion restricting member.
Figure 15:
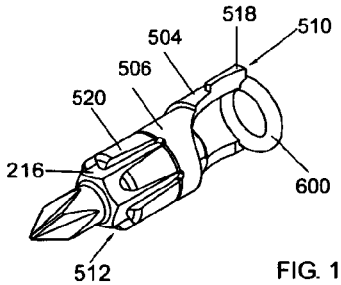
FIG. 15 is the perspective view of the motion restricting member showing one screwdriver tip emerging from the projections of the motion restricting member after the shank of the screwdriver bit having been rotated into alignment by the projections.
Figure 16:
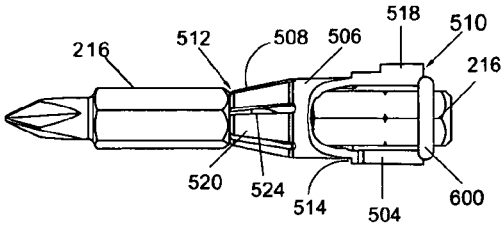
FIG. 16 is a side elevational view of the motion restricting member showing one screwdriver bit after having emerged from the projections of the motion restricting member with a portion of the motion restricting member cut away to show a second screwdriver bit behind the first.

In operation, screwdriver bits 216 are inserted into the assembled screwdriver 100 via the opening 406 in the cap 400, and through the O-ring 600, which frictionally engages the shank 220 of the screwdriver bit 216 to prevent the screwdriver bit from falling out of the cap. Once a screwdriver bit has been fully inserted into the cap, such that the end of shank 220 is flush with the opening 406 of the cap, the screwdriver bit 216 is situated within the motion restricting member 500 (FIG. 16). As the a subsequent screwdriver bit is inserted by the application of an axial force in the first direction, it pushes on the screwdriver bit within the motion restricting member to force that screwdriver bit through the anterior portion 508 of the motion restricting member (FIG. 14). As the shank 220 of this bit passes through the anterior portion 508, the projections 520 cause the shank 220 of the bit to rotate into alignment with the hexagonal portion 232 of passage 218 in the tubular member 200 so that the screwdriver bit may pass into the passage 218 (FIG. 15). Once this screwdriver bit passes completely through the anterior portion 508, the projections 520 return to their resting state to prevent the screwdriver bit from re-entering the motion restricting member (FIG. 16).

The illustrated embodiment of the screwdriver 100 accommodates five screwdriver bits, and each screwdriver bit is inserted as described. As the last screwdriver bit is inserted, the first or foremost screwdriver bit within the tubular member 200 emerges from the tip 300 to expose its tip 222 and the screwdriver 100 is in an operable configuration. This foremost screwdriver bit is frictionally held within tip 300 as described. When the screwdriver 100 is in the operable configuration, each screwdriver bit abuts the screwdriver bit behind it, and the end of the shank 220 of the fourth screwdriver bit abuts the projections 520 (which are in their resting state) of the motion restricting member, thereby preventing the screwdriver bits from being forced backward within the screwdriver 100. The last screwdriver bit is situated within the motion restricting member 500, and is frictionally held in place by O-ring 600 as described. When a different operable tip 222 is required, the screwdriver bit which is within tip 300 is withdrawn and inserted into the opening 406 thereby pushing the other screwdriver bits within the screwdriver forward to expose the operable tip 222 of the subsequent screwdriver bit. This is repeated until the desired operable tip 222 is exposed.

Advantageously, tubular member 200, cap 400 and motion restricting member 500 may be injection molded plastic, and the tip member 300 may be an injection molded elastomer, for ease of manufacture and reduced costs. The bits 216 may be standardized interchangeable screwdriver bits that are widely available in the industry. The O-ring is also widely available commercially. However, other suitable material may be used as would be apparent to persons skilled in the art.

As required, a detailed embodiment of the present invention is disclosed herein; however, it is to be understood that the disclosed embodiment is merely exemplary of the invention, which may be embodied in various forms. Therefore, specific structures and functional details disclosed herein are not to be interpreted as limiting, but merely as a basis for teaching one skilled in the art to variously employ the present invention in virtually any appropriately detailed structure.

I claim:

1. A multiple bit screwdriver comprising:

a plurality of tool bits, each bit having a tip and a shank;

an elongate tubular member having a first end and an opposite second end and defining an axial passage therethrough between the first and second ends, the passage being adapted to receive said tool bits therein positioned tip to end in a manner such that the tip of the foremost bit is able to operably extend from the first end, and wherein at least a portion of the passage near the first end is contoured for engagement with the shank of the foremost bit so that said bit is rotatable with the elongate member;

a first retainer connected to the elongate member at the first end and extending radially inward into the passage to engage frictionally the foremost bit to prevent said bit from falling out of the first end;

a second retainer connected to the elongate member at the second end and extending radially inward into the passage to engage frictionally the last bit to prevent said bit from falling out of the second end;

a tubular motion restricting member mounted coaxially within the passage having an engagement portion that cooperates with at least one tool bit to permit the movement of bits within the passage in a first direction from the second end to the first end but not in the opposite direction.

2. The apparatus as in claim 1 wherein the engagement portion of the motion restricting member comprises a stricture portion expandable between a resting state in which the stricture portion has an outlet that is narrower than the cross-sectional dimension of a tool bit shank, and an expanded state in which the outlet is large enough to permit a tool bit to pass therethough.

3. The apparatus as in claim 2 wherein the stricture portion is expandable in response a tool bit being pushed therethrough in the first direction by a user, but which resists expanding when a tool bit is being pushed in the opposite direction.

4. The apparatus as in claim 3 wherein:

the stricture portion comprises a plurality of longitudinal projections extending from the tubular portion of motion restricting member and gradually tapering toward the axis of the passage in the first direction; and each of the projections is deformable radially in response to the movement of a tool bit through the stricture portion in the first direction, but is resilient axially to restrict movement of the tool bit in the opposite direction.

5. The apparatus as in claim 4 wherein the contoured portion of the passage is hexagonal in cross section so as to accommodate tool bits having hexagonal shanks.

6. The apparatus as in claim 5 wherein the first retainer comprises a tip member connected to the first end of the elongate member and having an elastomeric flange portion that extends inwardly into the passage to define a tip opening that is slightly less than the cross sectional dimensions of a tool bit shank.

7. The apparatus as in claim 6 wherein the second retainer comprises an elastomeric ring member connected to the elongate member adjacent the second end and being coaxially aligned with the passage, the ring member defining an inlet opening at the second end of the passage that is slightly less than the cross sectional dimensions of a tool bit shank.

8. A multiple bit screwdriver comprising:

a plurality of tool bits, each bit having a tip and a shank;

a tubular member having a tip end and an opposite cap end and defining a first axial cavity extending from the tip end to the cap end;

a cap member having a connecting portion and a back end portion, and defining a second axial cavity extending from the connecting portion to the back end portion, the cap member further being connected at the connecting portion to the cap end of the tubular member such that the first and second cavities align axially to define an axial passage extending between the tip end of the tubular member and the back end portion of the cap member, said passage being adapted to receive said bits therein positioned tip to end in a manner such that the tip of the foremost bit is able to operably extend from the tip end, and wherein at least a portion of the passage near the tip end is contoured for engagement with the shank of the foremost so that said bit is rotatable with the tubular member;

a first retainer connected to the tip end of the tubular member and extending radially inward into the passage to engage frictionally the foremost bit to prevent said bit from falling out of the tip end;

a second retainer connected to the cap member near the back end portion and extending radially inward into the passage to engage frictionally the last bit to prevent said bit from falling out of the back end portion;

a motion restricting member mounted within the second cavity of the cap member and having an engagement portion that cooperates with at least one tool bit to permit the movement of bits within the passage in a first direction from the back end to the tip end, but not in the opposite direction.

9. The apparatus as in claim 8 wherein the motion-restricting member is tubular and is mounted coaxially with the passage.

10. The apparatus as in claim 9 wherein the engagement portion of the motion restricting member comprises a stricture portion expandable between a resting state in which the stricture portion has an outlet that is narrower than the cross-sectional dimension of a tool bit shank, and an expanded state in which the outlet is large enough to permit a tool bit to pass therethough.

11. The apparatus as in claim 10 wherein the stricture portion is expandable in response a tool bit being pushed therethrough in the first direction by a user, but which resists expanding when a tool bit is being pushed in the opposite direction.

12. The apparatus as in claim 11 wherein:

the stricture portion comprises a plurality of longitudinal projections extending from the tubular portion of motion restricting member and gradually tapering toward the axis of the passage in the first; and each of the projections is deformable radially in response to the movement of a tool bit through the stricture portion in the first direction, but is resilient axially to restrict movement of the tool bit in the opposite direction.

13. The apparatus as in claim 12 wherein contoured portion of the passage is hexagonal in cross section so as to accommodate tool bits having hexagonal shanks.

14. The apparatus as in claim 13 wherein the first retainer comprises a tip member connected to the tip end of the tubular member and having a elastomeric flange portion that extends inwardly into the passage to define a tip opening that is slightly less than the cross sectional dimensions of a tool bit shank.

15. The apparatus as in claim 14 wherein the second retainer comprises an elastomeric ring member connected adjacent the back end portion of the cap and being coaxially aligned with the passage, the ring member defining an inlet opening at the second end of the passage that is slightly less than the cross sectional dimensions of a tool bit shank.

* * * * *